United States Patent [19]

Bonapace

[11] Patent Number: 4,912,885

[45] Date of Patent: Apr. 3, 1990

[54] KNIFE SHARPENER

[76] Inventor: Mario J. Bonapace, 7396 Broadway, Lemon Grove, Calif. 92045

[21] Appl. No.: 269,361

[22] Filed: Nov. 10, 1988

[51] Int. Cl.[4] ..... B24B 3/36; B24B 3/54

[52] U.S. Cl. ..... 51/211 R; 51/285; 51/354; 76/82

[58] Field of Search ..... 76/82, 82.2, 86, 88; 51/204, 211 R, 211 H, 214, 285, 354

[56] References Cited

U.S. PATENT DOCUMENTS

| | | | |
|---|---|---|---|
| 1,952,106 | 3/1934 | Vierling | 51/354 |
| 2,124,646 | 7/1938 | Barsch | 51/354 |
| 4,073,094 | 2/1978 | Walz | 51/111 |

*Primary Examiner*—Frederick R. Schmidt
*Assistant Examiner*—Bruce P. Watson
*Attorney, Agent, or Firm*—Charles C. Logan, II

[57] ABSTRACT

A knife sharpener having a base, a pair of leg assemblies, a cover, and a pair of rod members formed of abrasive material. The leg assemblies each have an elongated leg member having a pivot pin passing downwardly therethrough to secure the leg member to the top surface of the base. The pivot ends of the respective leg assemblies are secured to the base at a position adjacent each other so that their free motion ends can pivot toward and away from each other. A spring is connected to the leg assemblies for maintaining a pressure that will force the free motion ends of the respective leg members apart from each other. The rod members are detachably supported in apertures formed in the top surface of the free motion ends of the respective leg members and the respective apertures are angularly oriented toward each other so that the rod members cross paths with one another to form a V and it is within this V that the blade of a knife would be passed in order to sharpen the cutting edge of the knife. The downward force of the knife blade when it is being sharpened causes the rod members on the respective leg members to pivot toward each other and when the pressure is released the spring will return them to their initial unloaded positions.

7 Claims, 1 Drawing Sheet

KNIFE SHARPENER

BACKGROUND OF THE INVENTION

The invention relates to sharpening devices and more specifically to a device adapted to sharpening the cutting edges of knives and other articles of cutlery.

Persons such as butchers who use professional quality knives in their employment require that their knives have a precise cutting edge on them at all times. The major beveled surface of the knife blade is sharpened by a professional sharpener. For the cutting tip of the blade however, the butcher generally has his own knife sharpening device that he uses periodically. It is this type of device which applicant has designed.

A prior art knife sharpening device is illustrated in the Johnson U.S. Pat. No. 1,041,631. It is hand held and it uses a pair of abrasive members having a flat surface mounted on arms that are pivotal about their top ends. A knife is drawn across the V formed by the adjacent abrasive members and downward pressure causes the arms to pivot laterally.

Another prior art type of sharpening device is illustrated in the Eisenhauer U.S. Pat. No. 1,365,161. It also uses flat surface abrasive members which are oriented angularly in opposite directions to form a V therebetween. A knife is drawn through this V in a similar fashion similar to that previously explained.

The Barsch U.S. Pat. No. 2,124,646 is directed to a knife sharpening device whose abrasive members have an arcuate surface and these abrasive members are mounted on holding elements that are pivotable about a point intermediate their length.

The Lambert U.S. Pat. No. 2,398,711 is directed to a knife sharpening device having its one abrasive member fixedly mounted and its other abrasive member adjustably mounted. A more complicated structure is illustrated in the Blankner knife sharpening device in U.S. Pat. No. 1,909,743.

It is an object of the invention to provide a novel knife sharpening device that is economical to manufacture and market.

It is also an object of the invention to provide a novel knife sharpening device that utilizes rods formed from abrasive material.

It is another object of the invention to provide a novel knife sharpening device having unique leg assemblies that are pivotable about one of their ends and these ends are positioned adjacent each other.

It is a further object of the invention to provide a novel knife sharpening device that allows the knife blade to be sharpened only on one side.

It is an additional object of the invention to provide a novel knife sharpening device that eliminates the problem of having the abrasive that comes off the knife and rod members dropping down into the mechanism and clogging it.

SUMMARY OF THE INVENTION

Applicant's novel knife sharpening device has a base, a pair of leg assemblies, and a cover. Each of the leg assemblies has an elongated leg member. One end of the leg member is the pivot end and the other is the free motion end. A vertically oriented aperture in the pivot end of the leg members has a pivot pin passing downwardly therethrough and the bottom end of the pivot pin is secured to the top surface of the base. The pivot ends of the respective leg assemblies are secured to the base at a position adjacent each other so that their free motion ends can pivot toward and away from each other. A pair of rod members formed of abrasive material have their respective bottom ends detachably supported in apertures formed in the top surface of the free motion ends of the respective leg members. These apertures are angularly oriented toward each other so that the rod members cross paths with one another to form a V where they intersect. A spring is connected to the leg assemblies for maintaining a pressure that will force the free motion ends of the respective leg members apart from each other. A cover having a top wall with a pair of arcuate slots in it mate with the respective members thus allowing them to extend upwardly above the top wall of the cover and the cover also controls how far apart the free motion ends of the leg members may travel.

The base and cover both have a configuration similar to that of a piece of pie. Aligned apertures in the cover and the base are provided to allow screws to be inserted therethrough in order to rigidly secure the knife sharpener to a counter or other type of support structure. When the knife structure is not rigidly secured to a structure, the suction cups provided on the bottom of the base keep it from sliding while under the pressure exerted by the knife against the rod members during the sharpening operation. The cutout portion in the base allows the abrasive debris from the knife and rod members to drop downwardly and out through the bottom of the base. This prevents the pivoting mechanism from getting clogged and becoming inoperative. The rod members may be cylindrically shaped or they may have a flat surface on them. The diameter of the rod members is slightly smaller than the diameter of the apertures in the top of the leg members which allows the rod members to be rotated so that all of their peripheral surface may be used at different times. If the rod members have a flat surface on them, they will self align with respect to each other once the blade of the knife is pressed downwardly into the V formed by the intersecting abrasive rods.

In order to sharpen the knife, the blade thereof is inserted into the V formed by the intersecting abrasive rod members and drawn back and forward thereover while applying a downward pressure. This causes the respective leg assemblies to travel in a pivotal motion apart from each other in the slots on the top wall of the cover while the edge of the knife is being sharpened between the two respective rod members. The angle of the V formed by the intersecting abrasive rod members will generally remain the same throughout the downward motion of the knife blade that causes the top ends of the abrasive rod members to spread laterally apart. This keeps both sides of the cutting edge of the knife blade in proper contact with the respective abrasive rod members at all times throughout the stroke. When the downward pressure is removed the spring will cause the free motion end of the leg members to separate from each other to their initial positions. Periodically the abrasive rod members may be rotated to use all of their circumferential surface.

With applicant's novel knife sharpening device, it is possible to apply the total pressure against only one of the rod members thus causing the knife edge to only be sharpened on one side. This is important for person's that skin animals, so they do not dig into the pelt and ruin it. Also important is the fact the bottom surface of the leg members is spaced upwardly a predetermined height above the top surface of the base. This allows a torquing action to be performed about the pivot pins when the edge of the knife blade is pushed downwardly into the V formed by the intersecting abrasive rod members.

DESCRIPTION OF THE PREFERRED EMBODIMENT

Figure 1:
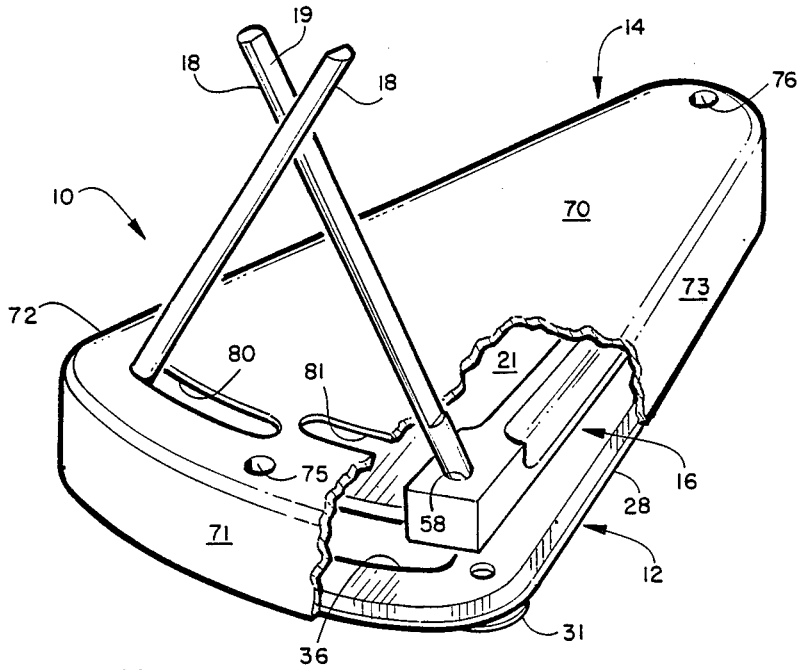
FIG. 1 is a front perspective view of applicant's novel knife sharpening device.
Figure 2:
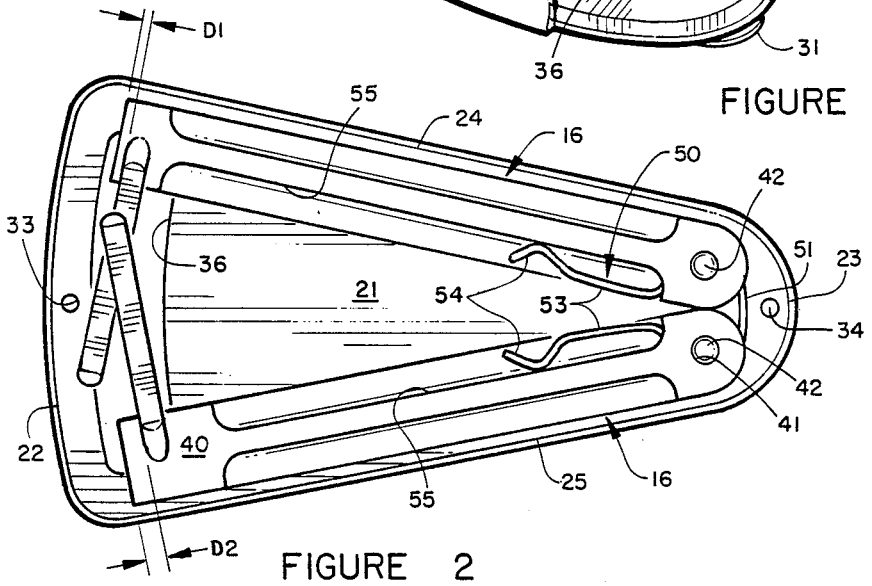
FIG. 2 is a top plan view of applicant's knife sharpening device with the cover removed.
Figure 3:
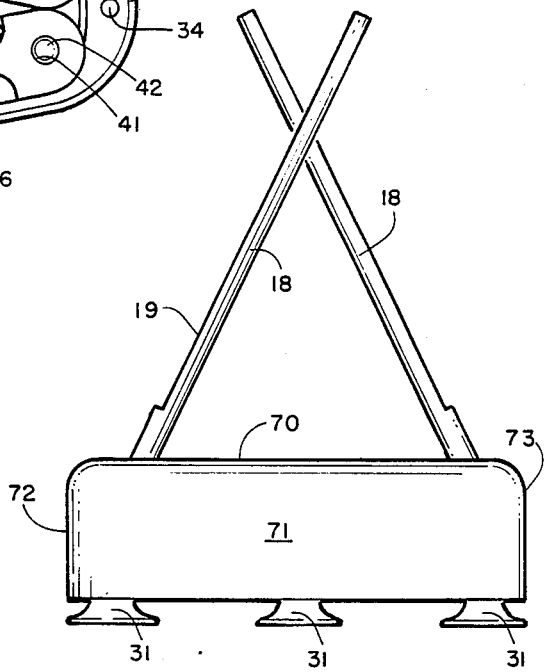
FIG. 3 is a front elevation view of applicant's novel knife sharpening device.
Figure 4:
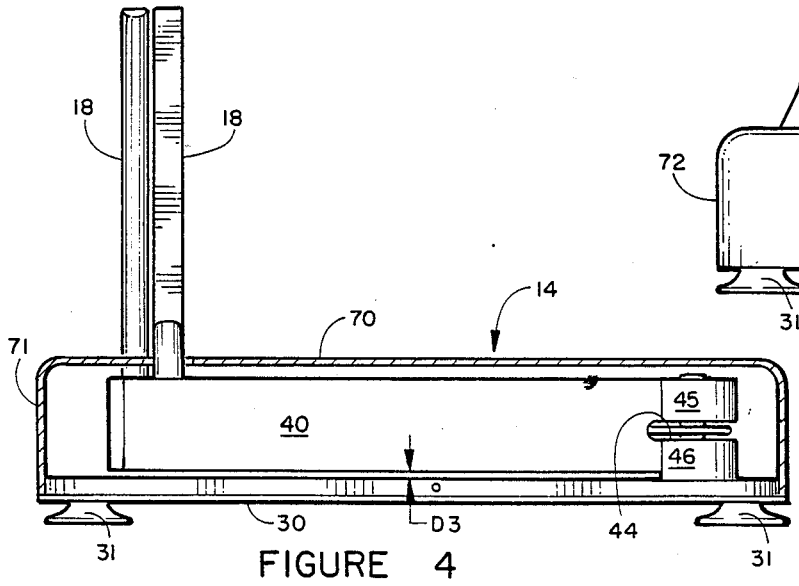
FIG. 4 is a side elevation view of applicant's novel knife sharpening device with the cover being shown in cross section.

Applicant's novel knife sharpening device will now be described by referring to FIGS. 1–4 of the drawing. The knife sharpening device is generally designated numeral 10.

Knife sharpening device 10 has a base 12, a cover 14, a pair of leg assemblies 16, and elongated abrasive rod members 18.

Base 12 has a configuration that looks like a piece of pie. It has a top wall 21, front wall 22, rear wall 23, and side walls 24 and 25. A flange 28 extends around the periphery of the respective walls. Base 12 has a bottom wall 30 having a plurality of suction cups 31 attached thereto. Apertures 33 and 34 are formed in the respective front and rear areas of the top wall 21 for receiving screws or other type of fastening hardwear. A cutout portion 36 extends across a majority of the width of the front end of the base and it allows the abrasive that comes off the knife and rod members, which has dropped downwardly to pass outwardly through the bottom of the base thus eliminating a build up that would clog the mechanism of the knife sharpening device.

Leg assemblies 16 have elongated leg members 40 and they have apertures 41 in their forward ends throughwhich extend pivot pins 42 that have their bottom ends secured in base 12. The forward end of the respective leg members 40 have a rounded front end and they are positioned adjacent to each other. A horizontal slot 44 is formed in the front end of each of these leg members 40 and they form upper pivot knobs 45 and lower pivot knobs 46. A spring 50 having a loop portion 51 passes around the respective pivot pins 42 through slot 44. Spring 50 has legs 53 with toe portions 54 that press against the vertical walls of relieved portions 55. Angularly oriented apertures 58 are formed in the top surface of leg members 40 and elongated abrasive rod members 18 are detachably received therein. The apertures 58 are spaced inwardly from the rear end of legs 40 a distance D1 and D2 respectively so that they pivot in different arcs and are allowed to cross each other in a contacting manner but not such that they cannot freely move past each other. The bottom surface of legs 40 are relieved a sufficient space D3 from lower pivot knob 46 rearwardly so that their free motion end is cantilevered and can receive a torquing action as the blade of the knife is pressed downwardly in the V formed by the respective rod members.

Cover 14 has a top wall 70, a front wall 71, and lateral side walls 72 and 73. Apertures 75 and 76 align with apertures 33 and 34 respectively for receiving screws or other hardware fasteners. Arcuate slots 80 and 81 are formed in top wall 70 to allow rod members 18 to pass upwardly therethrough. Rod members 18 have a flat surface 19 formed on one of their lateral sides.

What is claimed is:

1. A knife sharpener comprising:

a base having a top surface and a bottom surface;

a pair of leg assemblies each having an elongated leg member having a longitudinally extending axis, said leg members having a pivot end and a free motion end, said leg members having a top surface, laterally spaced side surfaces and a bottom surface, a vertically oriented aperture in said pivot end with a pivot pin passing downwardly therethrough, and having its bottom end secured in the top surface of said base, the pivot ends of said respective leg assemblies being secured to said base at a position adjacent each other so their free motion ends can pivot toward and away from each other, when said free motion ends have been pivoted toward each other until their respective side surfaces contact each other the respective longitudinal axes of said leg members will be substantially parallel to each other, when said free motion ends are separated from each the longitudinal axes of said leg members intersect each other;

spring means connected to said leg assemblies for maintaining a pressure that will force the free motion ends of said respective leg members apart from each other;

means for controlling how far apart the free motion ends of said leg members may travel; and a pair of rod members each having a longitudinally extending axis, said rod members being formed of abrasive material having their respective bottom ends detachably supported in apertures formed in the top surface of the free motion ends of said respective leg members, said respective apertures being angularly oriented toward each other so that said rod members cross paths with each other, the longitudinal axes of said rod members extend laterally with respect to the top surface of said leg members.

2. A knife sharpener as recited in claim 1 wherein said means for controlling how far apart the free motion ends of said leg members may travel comprises a cover having a top wall that has a pair of arcuate slots that mate with the respective rod members thus allowing them to extend upwardly above the top wall of said cover.

3. A knife sharpener as recited in claim 2 wherein said base and said cover both have a configuration similar to that of a piece of pie.

4. A knife sharpener as recited in claim 2 further comprising a cutout portion in said base directly below said arcuate slots so that the abrasive material that comes off the knife and rod members can drop therethrough and out of the knife sharpener.

5. A knife sharpener as recited in claim 1 wherein each of said rod members have an axially extending flat surface for sharpening knives.

6. A knife sharpener as recited in claim 1 further comprising a plurality of suction cups attached to the bottom surface of said base.

7. A knife sharpener comprising:

a base having a top surface and a bottom surface;

a pair of leg assemblies each having an elongated leg member, said leg members having a pivot end and a free motion end, said leg members having a top surface and a bottom surface, a vertically oriented aperture in said pivot end with a pivot pin passing downwardly therethrough and having its bottom end secured in the top surface of said base, the pivot ends of said respective leg assemblies being secured to said base at a position adjacent each other so their free motion ends can pivot toward and away from each other;

spring means connected to said leg assemblies for maintaining a pressure that will force the free motion ends of said respective leg members apart from each other;

said leg members each having a horizontal slot in their pivot end that forms upper and lower pivot knobs, said spring means comprising a loop portion with a pair of legs that extend generally in the same direction, said loop portion passing through said respective horizontal slots and around said respective pivot pins;

means for controlling how far apart the free motion ends of said leg members may travel; and a pair of rod members formed of abrasive material having their respective bottom ends detachably supported in apertures formed in the top surface of the free motion ends of said respective leg members, said respective apertures being angularly oriented toward each other so that said rod members cross paths with each other.

* * * * *